United States Patent [19]

Dätwyler

[11] Patent Number: 4,693,792

[45] Date of Patent: Sep. 15, 1987

[54] SYSTEM FOR ELECTROLYTICAL TREATMENT OF PRINTING CYLINDERS

[75] Inventor: Max Dätwyler, Langenthal, Switzerland

[73] Assignee: MDC Max Dätwyler Bleienbach AG, Bleienbach, Switzerland

[21] Appl. No.: 940,010

[22] Filed: Dec. 10, 1986

[30] Foreign Application Priority Data

Dec. 16, 1985 [CH] Switzerland ..... 05358/85

[51] Int. Cl.[4] ..... C25D 5/00

[52] U.S. Cl. ..... 204/25; 204/218

[58] Field of Search ..... 204/25, 212, 218

[56] References Cited

FOREIGN PATENT DOCUMENTS

| | | | |
|---|---|---|---|
| 0082268 | 6/1983 | European Pat. Off. | 204/218 |
| 637997 | 8/1983 | Switzerland | 204/218 |
| 639431 | 11/1983 | Switzerland | 204/218 |

*Primary Examiner*—T. M. Tufariello

*Attorney, Agent, or Firm*—Benoit Law Corporation

[57] ABSTRACT

During electrolytical treatment, a printing cylinder is held between center points, of which one is provided adjustably with a centering sleeve in a tail spindle. A belt connects the tail spindle in force transmitting relationship to a drive. The tail spindle is axially displaceable together with the inner housing of the apparatus, so that an electric contact ring at the end of the tail spindle is engageable with the front surface of a printing cylinder. The current conduction to the contact ring takes place via cooled carbon brushes located between the tail spindle bearings and the contact ring. A current conducting sleeve encompassing the end region of the tail spindle and being contacted by the carbon brushes, prevents the tail spindle carrying the printing cylinder from being exposed to electric current.

20 Claims, 6 Drawing Figures

PRIOR ART

SYSTEM FOR ELECTROLYTICAL TREATMENT OF PRINTING CYLINDERS

BACKGROUND OF THE INVENTION

1. Field of the Invention

The invention relates to apparatus and methods for galvanic or electrolytic treatment of printing cylinders.

2. Information Disclosure Statement

An apparatus for electrolytical treatment of printing cylinders has become known under the trademark "Cr-jet-Master" of the assignee of the entire interest, and is shown in FIG. 1. In that apparatus, the current supply takes place via carbon brushes located between the two bearings of the tail spindle in immediate electrical contact therewith. In consequence, the tail spindle, mechanically loaded by the printing cylinder being treated, in the region of its bearings and also by the bearings themselves, is heated by electric current conduction and friction of the carbon brushes, if the electric current is not adequately limited. Enlargement of the cross-section used for current conduction is impossible in view of the dimensions of the electrolyte trough, if in case of printing cylinders of various diameters an optimum spacing of about forty millimeters with respect to the anodes provided at the slanted walls of the electrolyte trough is to be preserved also during treatment of the smaller printing cylinders.

Reference may in this respect also be had to Swiss Patent Nos. 637997 and 639431, by Max Brenner et al, issued Aug. 31, 1983 and Nov. 15, 1983, respectively, to Graphicart Internationale Ausrüstungsgesellschaft für graphische Kunst AG, for apparatus for copper-plating rotary structures, especially rotogravure printing cylinders, wherein current conduction proceeds from the rotary structure through wedge-shaped abutting ring segments and a non-rotary conductor extending through a rotary bellows. European Patent Publication No. 0 082 268, by Karl Saueressig, of Saueressig & Co., published June 29, 1983, for apparatus for electroplating a rotary printing cylinder, discloses an arrangement in which carbon brushes contact a sleeve at a side of a bearing opposite the side at which that sleeve contacts the printing cylinder.

SUMMARY OF THE INVENTION

It is a general object of this invention to improve electrolytical treatment of printing cylinders.

It is a germane object of the invention to avoid objectionable heating of the tail spindle in its bearing region and to enable higher electric current intensities at lower losses.

Other objects will become apparent in the further course of this disclosure.

From a first aspect thereof, the subject invention resides in apparatus for electrolytic or galvanic treatment of printing cylinders, with an electrolyte trough, means including a rotatably mounted tail spindle for mounting and rotating each printing cylinder, and means for supplying electric currents to a contact ring supported by the tail spindle for contacting a front surface of each printing cylinder. The invention according to this aspect resides, more specifically, in the improvement comprising, in combination, carbon brushes for conducting electric current in the supplying means, and means for situating these carbon brushes between bearings of the tail spindle and the contact ring.

From a related aspect thereof, the subject invention resides in a method of electrolytically or galvanically treating printing cylinders suspended in an electrolyte bath by means including a rotatably mounted tail spindle and supplied with electric currents via a contact ring supported by the tail spindle for contacting a front surface of each printing cylinder. The invention according to this aspect resides, more specifically, in the improvement comprising in combination the steps of providing carbon brushes for conducting electric current to the contact ring, and situating the carbon brushes between bearings of the tail spindle and the contact ring.

Other aspects of the invention will become apparent in the further course of this disclosure, and no restriction is intended by this Summary of the Invention.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
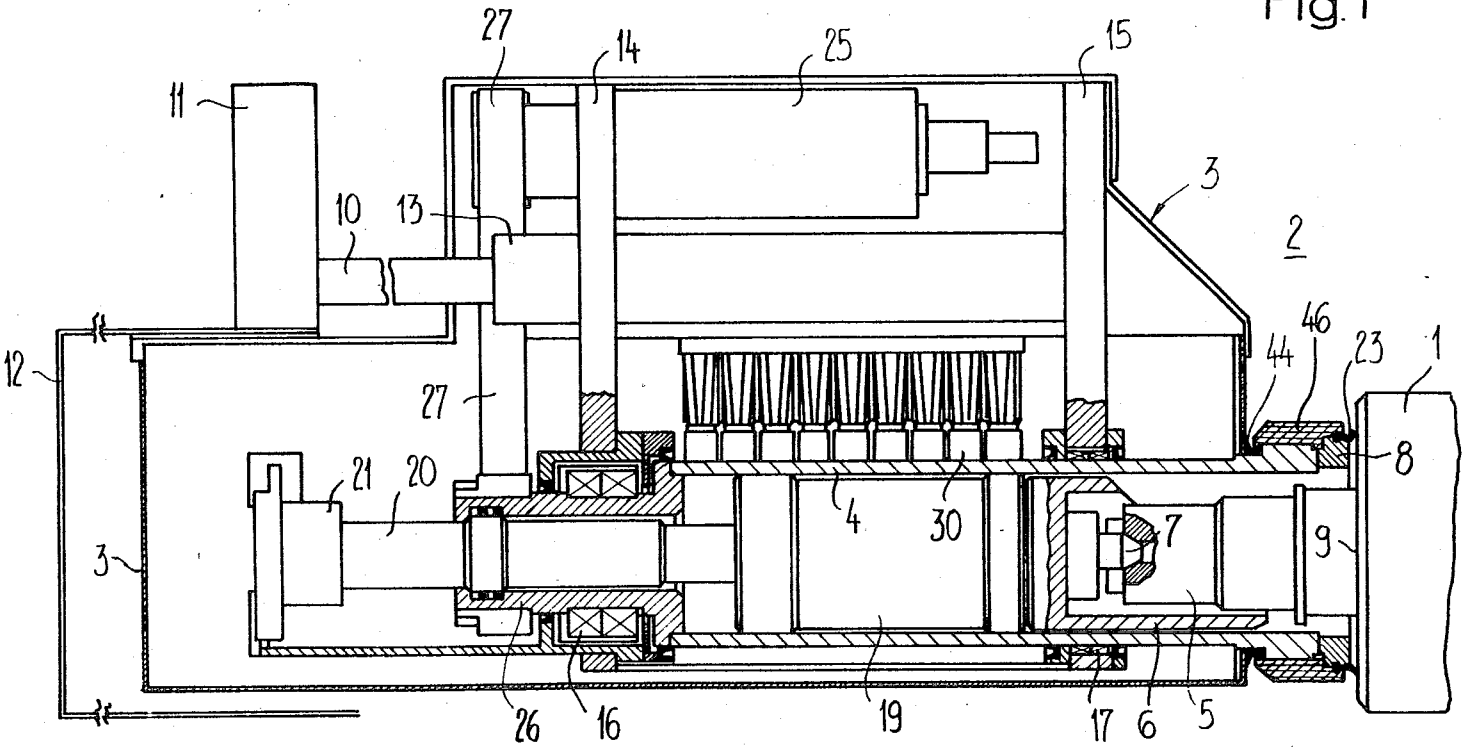
FIG. 1 is a side view, partially in section, of the assignee's above mentioned prior apparatus in the current supply region.
Figure 2:
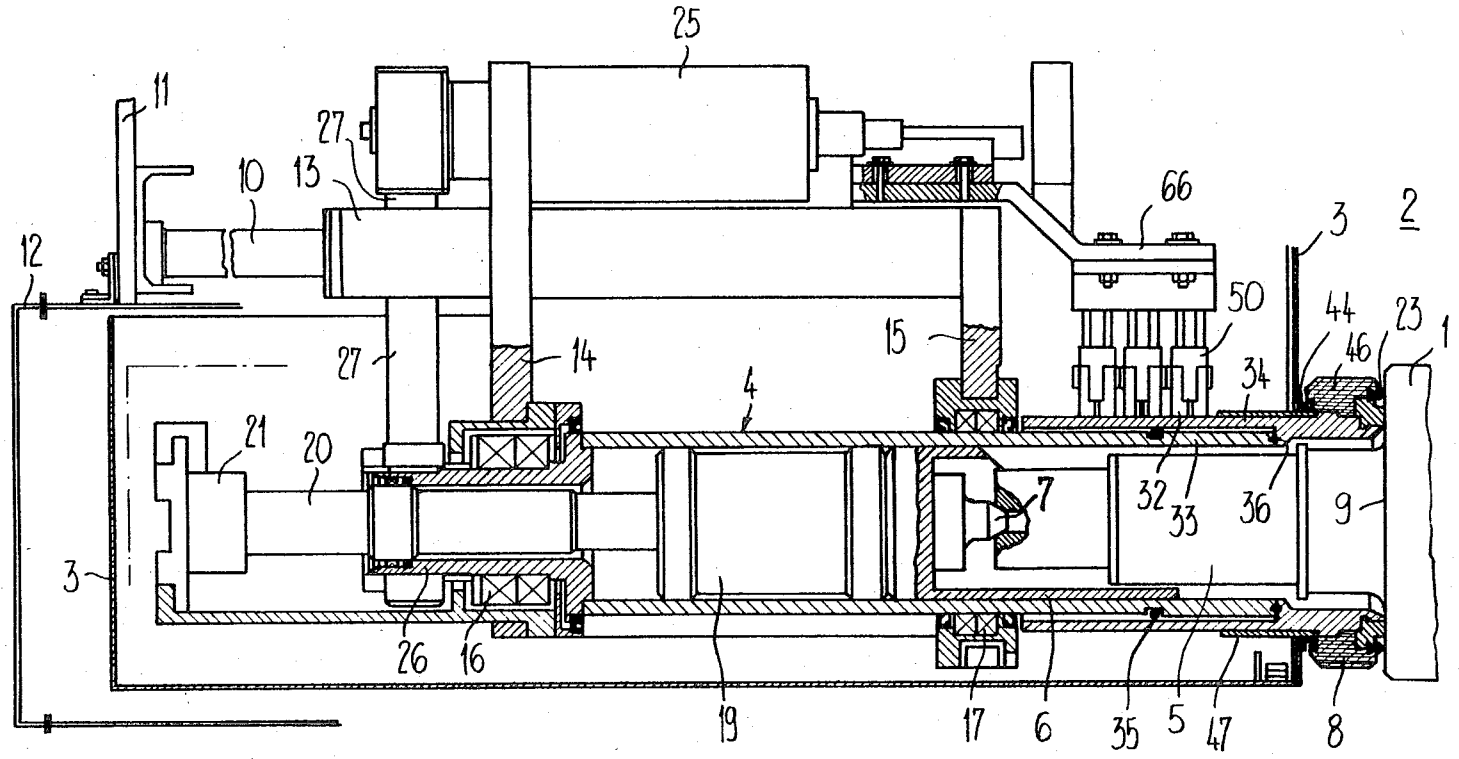
FIG. 2 is a view similar to FIG. 1, but showing a preferred embodiment of the subject invention.

A comparison of the contents of FIGS. 1 and 2 shows that the drive and bearing system of the apparatus according to the preferred embodiment of the invention essentially may be the same as that of the above mentioned prior apparatus of the assignee, and, therefore, is only briefly described herein.

That drive and bearing system for the printing cylinder 1 being electrolytically or galvanically treated is provided at an end of an only schematically indicated electrolyte bath or trough 2, which accommodates the printing cylinder to be treated.

Such electrolytic treatment may, for instance, comprise a galvanic deposition of a metal, such as copper, on the circumferential surface of the printing cylinder. For that purpose, several anodes (not shown) are serially arranged in the electrolyte trough in longitudinal direction.

In order to effect a connection of the printing cylinder 1 with the drive and bearing system, the boat-like shiftable inner housing 3, enclosing the drive and bearing system, together with the tail spindle 4 is shifted outwardly; that is, to the left as seen in FIGS. 1 and 2, so that the pivot or shaft journal 5 of the centering shell 6 is positioned upon a lowering of the printing cylinder. This also requires relative motion between the centering shell 6 held adjustably in the tail spindle 4 with the centering point 7 and the tail spindle 4, so that the centering shell 6 projects axially beyond an electric contact ring 8 by the length of the journal shaft 5. Thereafter, the inner housing 3 and thereby also the tail spindle 4 is shifted in opposite direction, until the electric contact ring 8 has reached its contact with the front or side surface 9 of the printing cylinder 1.

Pneumatic or hydraulic drives or actuators exist for effecting the above mentioned displacement motions, and may be combined with carriage guides. The displacement of the inner housing 3 is effected by means of a cylinder-piston unit, the piston rod 10 of which is affixed to a bearer strut 11 of the outer housing 12 that is interconnected with the electrolyte trough 2, and to the cylinder 13 of which the inner housing 3 is attached via its two supporting walls 14 and 15.

These mutually spaced and parallel supporting walls 14 and 15 take up the bearings 16 and 17 for the rotatable mounting of the tail spindle 4 so that the tail spindle 4 is axially fixed relative to the inner housing 3. The displacement of the centering shell 6 with the centering point 7, which may axially be resiliently mounted, within the tail spindle 4 is effected with a cylinder-piston unit, the piston rod of which (not visible in the drawing) is fixedly connected with a guide structure 19 which covers the centering shell 6, as well as the centering point 7, and the cylinder 20 of which is fixedly connected by a connector 21 to the inner housing 3.

In an upper part of the inner housing 3 there is provided a drive 25, which may be an electric motor, which is attached to a supporting wall 14 for driving the tail spindle 4 and thereby the printing cylinder 1, which is in force-transmitting drive connection with the tail spindle via the electric contact ring 8 and a sealing ring 23. The drive transmission from the drive 25 to the tail spindle belt 26 may, for instance, take place via a timing belt 27.

To the extent so far described, the design of the apparatus of the embodiment of the invention shown in FIGS. 2 to 6 may be the same as of the known apparatus of FIG. 1, so that so far like reference numerals have been employed.

According to the invention, the carbon brushes 32 are situated between the bearings 16 and 17 of the tail spindle 4 on the one hand, and the electric contact ring 8 on the other hand. According to the preferred embodiment of FIGS. 2 and 3, the carbon brushes 32 are situated in axial direction between (a) the tail spindle bearing 17 in which is located closest to the printing cylinder 1 or contact ring 8, and (b) that contact ring 8. In the illustrated embodiment, the carbon brushes 32 also are located axially beyond or outside of the bearing wall 15 of the inner housing 3, which, as among all bearing walls 14 and 15, is located closest to the lateral face 9 of the printing cylinder 1 or closest to the electrolyte trough or bath 2. In particular, the carbon brushes 32 are situated in a region 33 of the tail spindle 4 located outside of the outer bearing wall 15, whereby the electric current path along the tail spindle 4 to the lateral cylinder surface 9 is materially shortened and objectionable heating and wear in the area of the tail spindle bearings are avoided.

According to the illustrated preferred embodiment, a current conducting sleeve 34 is provided which encompasses the above mentioned end region 33, so that also in that end region an electric current conduction through the tail spindle 4, loaded by the weight of the printing cylinder 1, is avoided. Stated differently, the current conducting means of the apparatus includes a current conducting sleeve 34 encompassing at least part of a length of the tail spindle 4 and being with a circumferential surface in contact with the carbon brushes 32.

Figure 3:
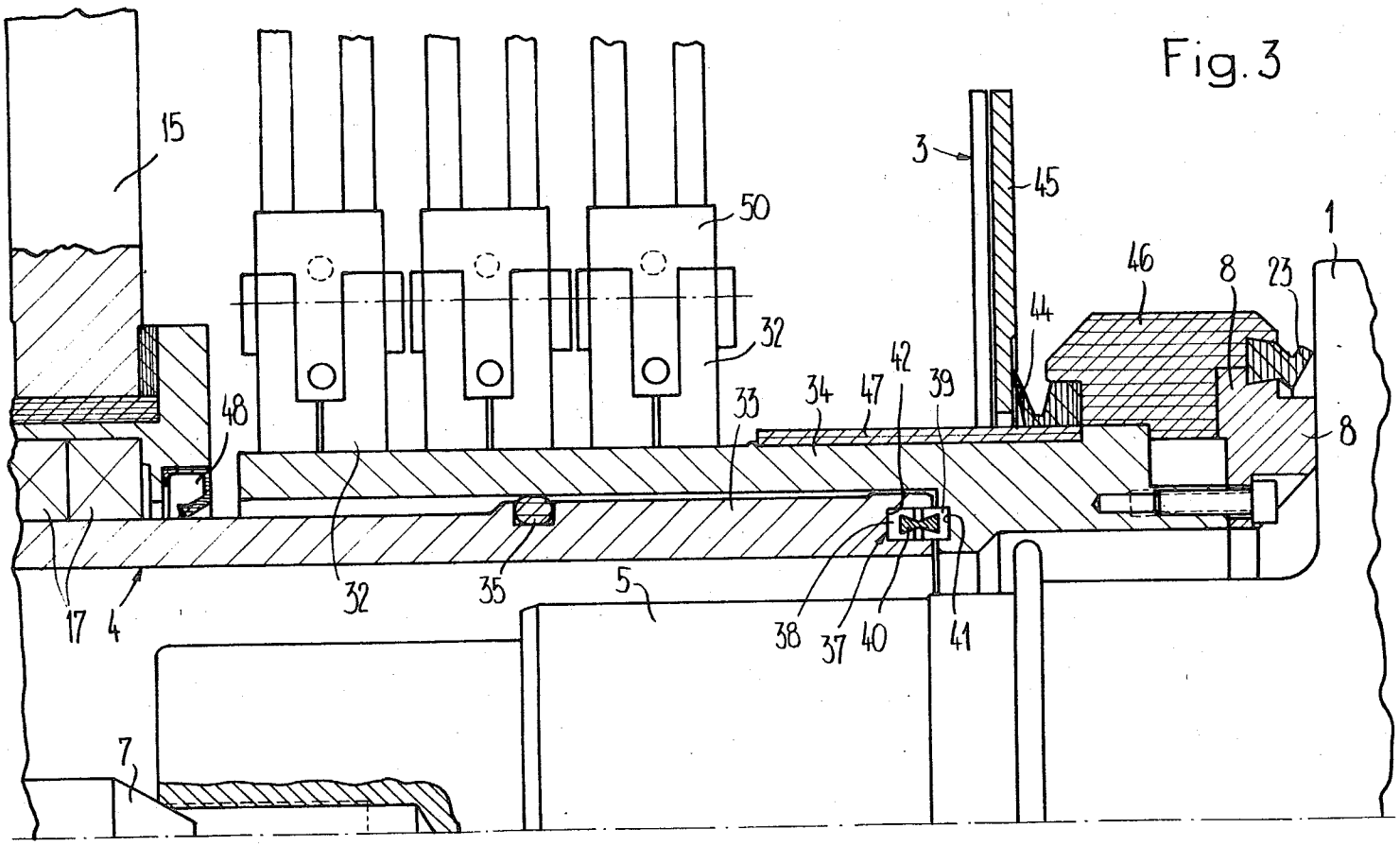
FIG. 3 is a view similar to FIG. 2 on an enlarged scale in the carbon brush area.

That conductive sleeve 34 is electrically connected to the contact ring 8, and a circumferential surface of that current conducting sleeve is contacted with the carbon brushes 32, as shown in FIGS. 2 and 3.

In order to avoid transmision of bending stresses in the tail spindle end region 33, the current conducting sleeve 34 preferably is elastically supported by the tail spindle 4 or at its end region 33. By way of example, elastic members 35 and 37 are located between the tail spindle and the current conducting sleeve 34 for supporting that conducting sleeve on the tail spindle. Preferably, the current conducting sleeve 34 is supported both radially and axially on the tail spindle 4. In this respect, elastic supporting members include an elastic device 35 for radially supporting the current conducting sleeve on the tail spindle, and an elastic device 40 for axially supporting that sleeve 34 relative to that tail spindle 4.

In practice, this may be accomplished by means of a radially supporting elastomeric or rubber ring 35 inlaid between the circumference of the tail spindle 4 and the current conducting sleeve 34, as well as of a device 37 in the nature of a rubber-elastic silent block which establishes the axial connection between, for instance, the front facing 36 of the tail spindle and the current conducting sleeve 34. By way of example, this device is formed by two elastic rings 38 and 39 and an annular coupling 40 which form-fittingly interconnects the latter, such as by means of an adhesive.

Axially oriented annular notches or recesses 41 and 42 in the current conducting sleeve 34 and in the tail spindle 4, respectively, accommodate each of the rubber or elastomeric rings 38 and 39, which preferably are mounted in the notches 41 and 42 by an adhesive or the like.

In order to prevent liquid electrolyte from reaching the inner housing 3 and the bearing and drive system, as well as the current supply arrangement, a sealing ring 44 is provided on the end of the conducting sleeve 34 carrying the electric contact ring 8. That sealing ring 44 is in addition to the sealing ring 23 abutting the printing cylinder 1 and is in elastic sliding abutment with the corrosion protective wall 45 of the inner housing.

An annular cover 46, which may be of a plastic material, retains both sealing rings 23 and 44 on the conducting sleeve and further serves to support the contact ring 8. In the region extending through wall 45, the conducting sleeve 34 moreover is encased in an electrically insulating protective sheath 47 which provides corrosion protection and which in conjunction with the sealing ring 44 prevents carbon particles and contaminants from the operation of the carbon brushes 32 from reaching the surface of the printing cylinder 1 being treated. A sealing ring 48 similarly protects the bearing 17 against carbon particles and other contaminants.

According to a preferred embodiment of the invention, a special cooling system for the carbon brushes is provided in order to increase their electric current rating. In particular, the carbon brushes 32 may be mounted and cooled with the aid of an abutting mounting block 50 having at least one coolant channel therein.

Figure 6:
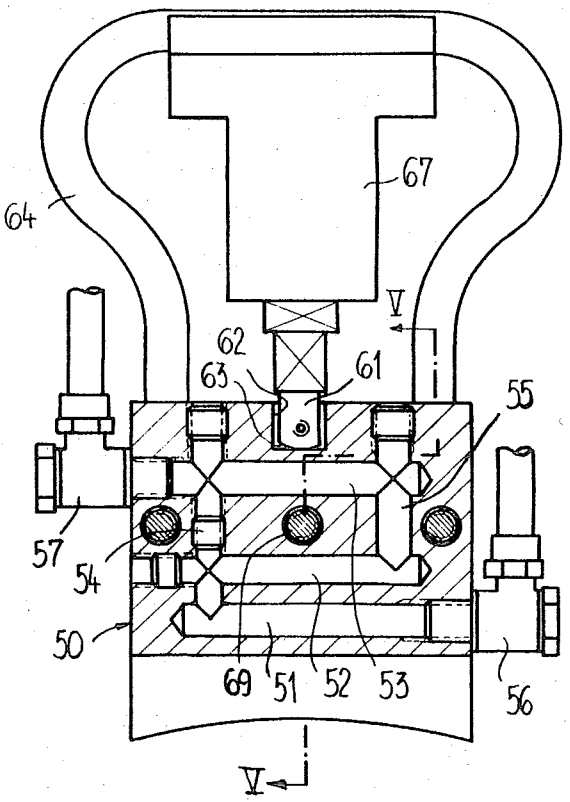
FIG. 6 is a cross-section through the carbon brush assembly to FIGS. 4 and 5, taken transversely to the tail spindle.
Figure 5:
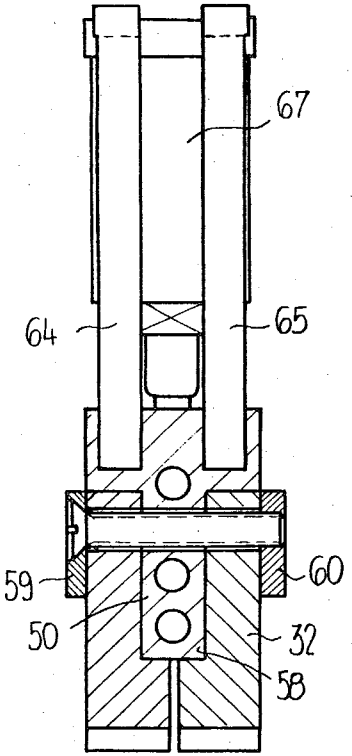
FIG. 5 is a cross-section through the carbon brush assembly of FIG. 4, taken perpendicularly to the tail spindle.
Figure 4:
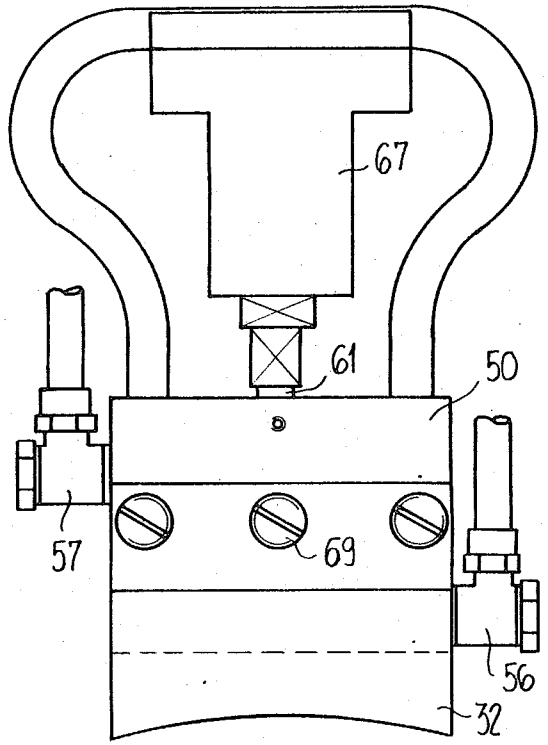
FIG. 4 is a side view of a carbon brush assembly according to an embodiment of the invention as seen in the direction of the tail spindle.

As seen in FIGS. 4 to 6, at least two carbon brushes are unified with one mounting block 50 having at least one coolant channel therein. The illustrated mounting block in fact has a number of bores 51 to 55 extending parallely and perpendicularly to each other in the same plane and forming a system of channels for cold water or another coolant entering through an inlet 56 and exiting through an outlet 57.

Carbon brushes 32 abut the mounting block 50 in pairs via contact areas 58 which are as large as possible, and are attached thereto by three penetrating screws 69 acting on pressure plates 59 and 60.

A conventional pressure spring (not shown) may be employed for biasing the carbon brushes 32 onto the conductive sleeve 34 via a bolt 61 which extends at lateral play into a blind-end bore 62 located centrally in the top of the mounting block 50 and which has a convex end surface 63 where it contacts the bottom of the bore.

The supply of electric current takes place through flexible stranded cables 64 and 65 fixedly attached to the mounting block 50 and having a common terminal connector 66 (see FIG. 2) at the top of the retainer 67 carrying also the above mentioned pressure spring.

The subject extensive disclosure will render apparent or suggest to those skilled in the art various modifications and variations within the spirit and scope of the subject invention and equivalents thereof.

I claim:

1. In apparatus for electrolytic or galvanic treatment of printing cylinders, with an electrolyte trough, means including a rotatably mounted tail spindle for mounting and rotating each printing cylinder, and means for supplying electric currents to a contact ring supported by the tail spindle for contacting a front surface of each printing cylinder, the improvement comprising in combination:

carbon brushes for conducting said electric current in said supplying means; and means for situating said carbon brushes between bearings of said tail spindle and said contact ring

2. Apparatus as claimed in claim 1, wherein:

said supplying means include a current conducting sleeve encompassing at least part of a length of said tail spindle and being with a circumferential surface in contact with said carbon brushes

3. Apparatus as claimed in claim 2, including:

means for mounting and cooling said carbon brushes, including an abutting mounting block having at least one coolant channel therein.

4. Apparatus as claimed in claim 3, wherein:

at least two carbon brushes are unified by one mounting block having at least one coolant channel therein.

5. Apparatus as claimed in claim 2, including:

elastic members located between the tail spindle and the current conducting sleeve for supporting said current conducting sleeve on said tail spindle.

6. Apparatus as claimed in claim 5, including:

means for mounting and cooling said carbon brushes, including an abutting mounting block having at least one coolant channel therein.

7. Apparatus as claimed in claim 6, wherein:

at least two carbon brushes are unified by one mounting block having at least one coolant channel therein.

8. Apparatus as claimed in claim 5, wherein:

said elastic members include an elastic device for radially supporting said current conducting sleeve on said tail spindle and an elastic device for axially supporting said sleeve relative to said tail spindle.

9. Apparatus as claimed in claim 8, including:

means for mounting and cooling said carbon brushes, including an abutting mounting block having at least one coolant channel therein.

10. Apparatus as claimed in claim 8, wherein:

at least two carbon brushes are unified by one mounting block having at least one coolant channel therein.

11. In a method of electrolytically or galvanically treating printing cylinders suspended in an electrolyte bath by means including a rotatably mounted tail spindle and supplied with electric currents via a contact ring supported by the tail spindle for contacting a front surface of each printing cylinder, the improvement comprising in combination the steps of:

providing carbon brushes for conducting said electric current to said contact ring; and situating said carbon brushes between bearings of said tail spindle and said contact ring.

12. A method as claimed in claim 11, including the steps of:

encompassing at least part of a length of said tail spindle with a current conducting sleeve electrically connected to said contact ring; and contacting a circumferential surface of said current conducting sleeve with said carbon brushes.

13. A method as claimed in claim 12, including the step of:

cooling said carbon brushes.

14. A method as claimed in claim 12, including the step of:

unifying at least two carbon brushes with one mounting block having at least one coolant channel therein.

15. A method as claimed in claim 12, including the step of:

supporting said current conducting sleeve on said tail spindle with elastic members located between the tail spindle and the current conducting sleeve.

16. A method as claimed in claim 15, including the step of:

cooling said carbon brushes.

17. A method as claimed in claim 15, including the step of:

unifying at least two carbon brushes with one mounting block having at least one coolant channel therein.

18. A method as claimed in claim 12, including the step of:

supporting said current conducting sleeve both radially and axially on said tail spindle.

19. A method as claimed in claim 18, including the step of:

cooling said carbon brushes.

20. A method as claimed in claim 18, including the step of:

unifying at least two carbon brushes with one mounting block having at least one coolant channel therein.

* * * * *